US011738969B2

(12) United States Patent
Singaraju et al.

(10) Patent No.: US 11,738,969 B2
(45) Date of Patent: Aug. 29, 2023

(54) SYSTEM FOR PROVIDING ELEVATOR SERVICE TO PERSONS WITH PETS

(71) Applicant: OTIS ELEVATOR COMPANY, Farmington, CT (US)

(72) Inventors: Ravikiran Singaraju, Telangana (IN); Aditya Swami, Hyderabad (IN); Tejas Arunrao Dhumal, Maharashtra (IN); Ranjith Vushakola, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 958 days.

(21) Appl. No.: 16/683,669

(22) Filed: Nov. 14, 2019

(65) Prior Publication Data

US 2020/0165101 A1 May 28, 2020

(30) Foreign Application Priority Data

Nov. 22, 2018 (IN) ..... 201811044083

(51) Int. Cl.

| | |
|---|---|
| ***B66B 1/46*** | (2006.01) |
| ***B66B 1/24*** | (2006.01) |
| ***B66B 5/00*** | (2006.01) |

(52) U.S. Cl.

CPC ..... *B66B 1/468* (2013.01); *B66B 1/2408* (2013.01); *B66B 5/0012* (2013.01); (Continued)

(58) Field of Classification Search

CPC ..... B66B 1/468; B66B 1/2408; B66B 5/0012; B66B 2201/104; B66B 2201/222; B66B 2201/405; B66B 2201/4669; B66B 1/28; B66B 1/3461; B66B 5/0031; B66B 2201/4638

See application file for complete search history.

(56) References Cited

U.S. PATENT DOCUMENTS

| | | | |
|---|---|---|---|
| 5,258,586 | A | 11/1993 | Suzuki et al. |
| 8,020,672 | B2 | 9/2011 | Lin et al. |

(Continued)

FOREIGN PATENT DOCUMENTS

| | | | |
|---|---|---|---|
| CN | 101356108 | A | 1/2009 |
| CN | 104891286 | A | 9/2015 |

(Continued)

OTHER PUBLICATIONS

European Search Report; Application No. 19210929.6; dated Apr. 23, 2020; 5 pages.

(Continued)

*Primary Examiner* — Jeffrey Donels
(74) *Attorney, Agent, or Firm* — Cantor Colburn LLP

(57) ABSTRACT

Disclosed is an elevator system including a controller, wherein the controller is configured for: engaging in a first communication with a facial recognition system that identifies a pet and a first person as owner of the pet, and rendering a plurality of determinations from the first communication, including: a first determination that the pet is proximate a first elevator lobby in a building, a second determination to provide instructions to a first elevator car responsive to the first communication, and engaging in a second communication with the first elevator car for effecting the second determination.

20 Claims, 8 Drawing Sheets

(52) U.S. Cl.
CPC ... *B66B 2201/104* (2013.01); *B66B 2201/222* (2013.01); *B66B 2201/405* (2013.01); *B66B 2201/4669* (2013.01)

(56) References Cited

U.S. PATENT DOCUMENTS

| | | | | |
|---|---|---|---|---|
| 9,342,735 | B2 | 5/2016 | Polimeno et al. | |
| 10,017,355 | B2 | 7/2018 | Silvennoinen et al. | |
| 2009/0057068 | A1 | 3/2009 | Lin et al. | |
| 2015/0131868 | A1 | 5/2015 | Rooyakkers et al. | |
| 2016/0031675 | A1 | 2/2016 | Silvennoinen et al. | |
| 2016/0289042 | A1* | 10/2016 | Fang | G06T 7/73 |
| 2016/0289044 | A1 | 10/2016 | Hsu et al. | |

FOREIGN PATENT DOCUMENTS

| | | | |
|---|---|---|---|
| CN | 105989343 | A | 10/2016 |
| CN | 107010503 | A | 8/2017 |
| EP | 2069224 | A1 | 6/2009 |
| JP | 2001233554 | A | 8/2001 |
| JP | 2003002548 | A | 1/2003 |
| JP | 2004331261 | A | 11/2004 |
| JP | 2007261746 | A | 10/2007 |
| JP | 2007290811 | A | 11/2007 |
| JP | 2015020820 | A | 2/2015 |
| JP | 2016003097 | A | 1/2016 |
| JP | 2016064910 | A | 4/2016 |
| JP | 2018095436 | A | 6/2018 |
| KR | 20150101760 | A | 9/2015 |
| WO | 2017175021 | A1 | 10/2017 |

OTHER PUBLICATIONS

Office Action for Application No. 19210929.6, dated Oct. 14, 2021.
Office Action for Application No. 201911147793.9, dated Feb. 14, 2022.
Office Action for Application No. 201911147793.9, dated Sep. 24, 2021.

* cited by examiner

SYSTEM FOR PROVIDING ELEVATOR SERVICE TO PERSONS WITH PETS

CROSS-REFERENCE TO RELATED APPLICATIONS

This application claims the benefit of Indian Application No. 201811044083 filed Nov. 22, 2018, the disclosure of which is incorporated herein by reference in its entirety.

BACKGROUND

The embodiments described herein relate to an elevator system and more specifically to an elevator system that provides elevator service to passengers with pets.

Person(s) who are pet owners may request elevator service accompanied by a pet such as a cat or dog. This may be a concern for other passengers who are uncomfortable around pets. In addition, persons who are pet owners and other passengers without such pets may wish to track when such pets enter an elevator car unaccompanied by the pet owners.

SUMMARY

Disclosed is an elevator system comprising a controller, wherein the controller is configured for: engaging in a first communication with a facial recognition system that identifies a pet and a first person as owner of the pet, and rendering a plurality of determinations from the first communication, including: a first determination that the pet is proximate a first elevator lobby in a building, a second determination to provide instructions to a first elevator car responsive to the first communication, and engaging in a second communication with the first elevator car for effecting the second determination.

In addition to one or more of the above disclosed features or as an alternate the second determination includes: determining that elevator service is requested at the first elevator lobby by the first person with the pet, determining that the first elevator car is empty, and determining to assign the first elevator car to provide elevator service at the first elevator lobby, and to instruct the first elevator car to bypass other lobbies while traveling to the first elevator lobby.

In addition to one or more of the above disclosed features or as an alternate the second determination includes: determining that elevator service is requested at a first elevator by the first person with the pet, determining that the first elevator car is currently transporting other passengers to one or more other lobbies, determining that the first elevator car is traveling to the first elevator lobby to provide elevator service at the first elevator lobby, and determining to instruct the first elevator car to bypass the first elevator lobby.

In addition to one or more of the above disclosed features or as an alternate the controller renders a third determination to provide alternate elevator service at the first elevator lobby, the third determination including: determining that a second elevator car is empty, determining to assign the second elevator car to provide elevator service at the first elevator lobby, and to instruct the second elevator car to bypass other lobbies while traveling to the first elevator lobby, and wherein the controller engages in a third communication with the second elevator car for effecting the third determination.

In addition to one or more of the above disclosed features or as an alternate the second determination includes: determining that the first elevator car is at the first elevator lobby with elevator doors in a retracted configuration, determining that the pet is unattended at the first elevator lobby and the pet is entering or is within the first elevator car, and determining to instruct the first elevator car to remain parked at the first lobby with elevator doors in the opened configuration until the pet exits the first elevator car.

In addition to one or more of the above disclosed features or as an alternate the controller is configured to: render a fourth determination to communicate a first alert which is a pet attendance alert, including: determining to instruct a mobile device for the first person to display an alert that the pet is unattended at the first elevator lobby, and engaging in a fourth communication with the mobile device to effect the fourth determination.

In addition to one or more of the above disclosed features or as an alternate the fourth determination includes to contact a building management system (BMS) and informing the BMS that the first elevator car is parked at the first elevator lobby with the elevator doors in an opened configuration to accommodate an unattended pet.

In addition to one or more of the above disclosed features or as an alternate the controller communicates with the first elevator car over a controller area network (CAN). In addition to one or more of the above disclosed features or as an alternate the controller communicates with the mobile device over a personal area network (PAN). In addition to one or more of the above disclosed features or as an alternate the controller communicates with the BMS over a local area network (LAN).

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
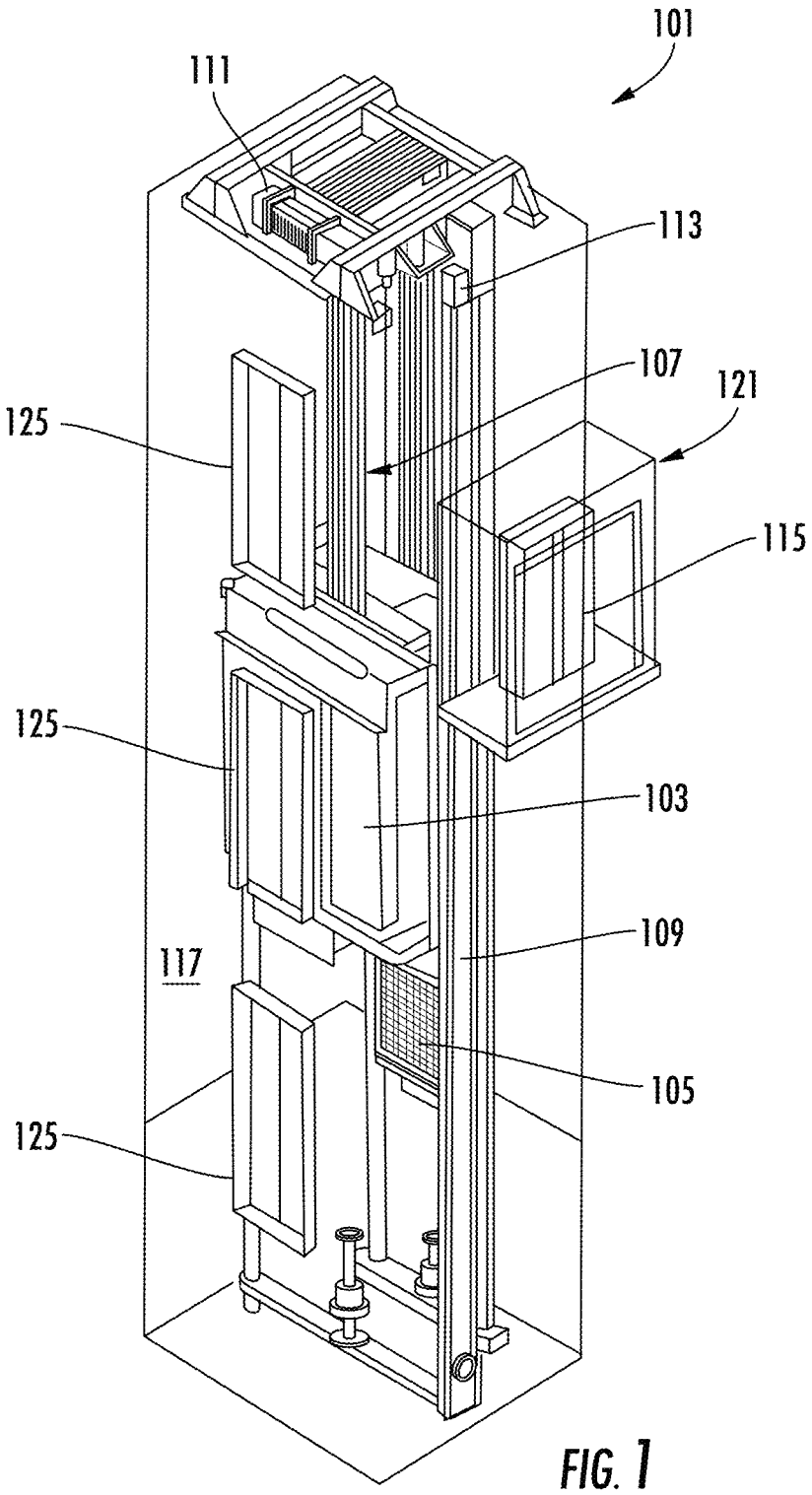
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

The following figures illustrate additional technical features associated with one or more disclosed embodiments. Features disclosed in the following figures having nomenclature similar to features disclosed in FIG. 1 may be similarly construed though being positively reintroduced with numerical identifiers that may differ from those in FIG. 1. Further, process steps disclosed hereinafter may be sequentially numbered to facilitate discussion of one or more disclosed embodiments. Such numbering is not intended to identify a specific sequence of performing such steps or a specific requirement to perform such steps unless expressly indicated.

Figure 2:
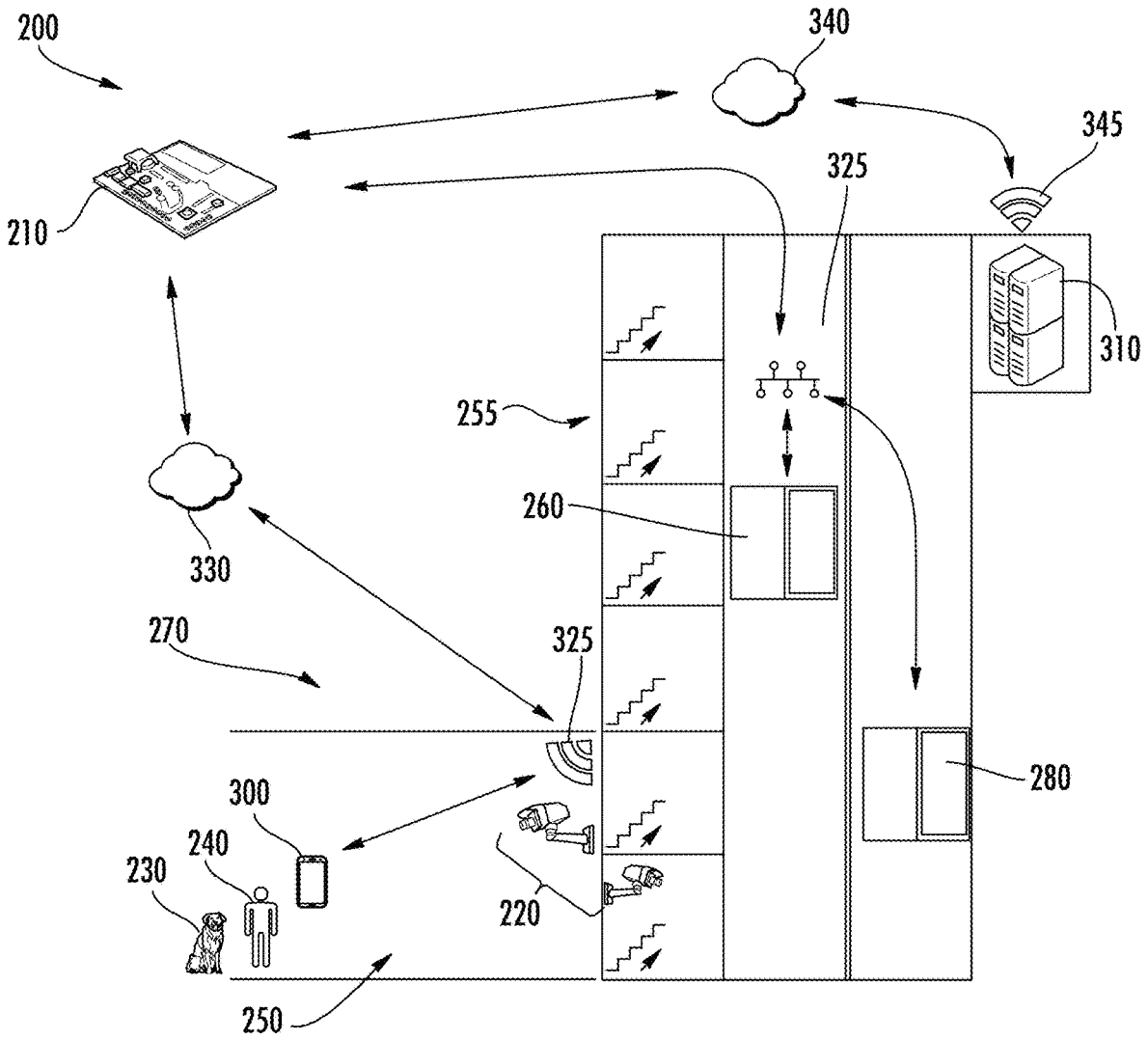
FIG. 2 illustrates components of a disclosed embodiment wherein the system provides elevator service to a person with a pet.
Figure 5:
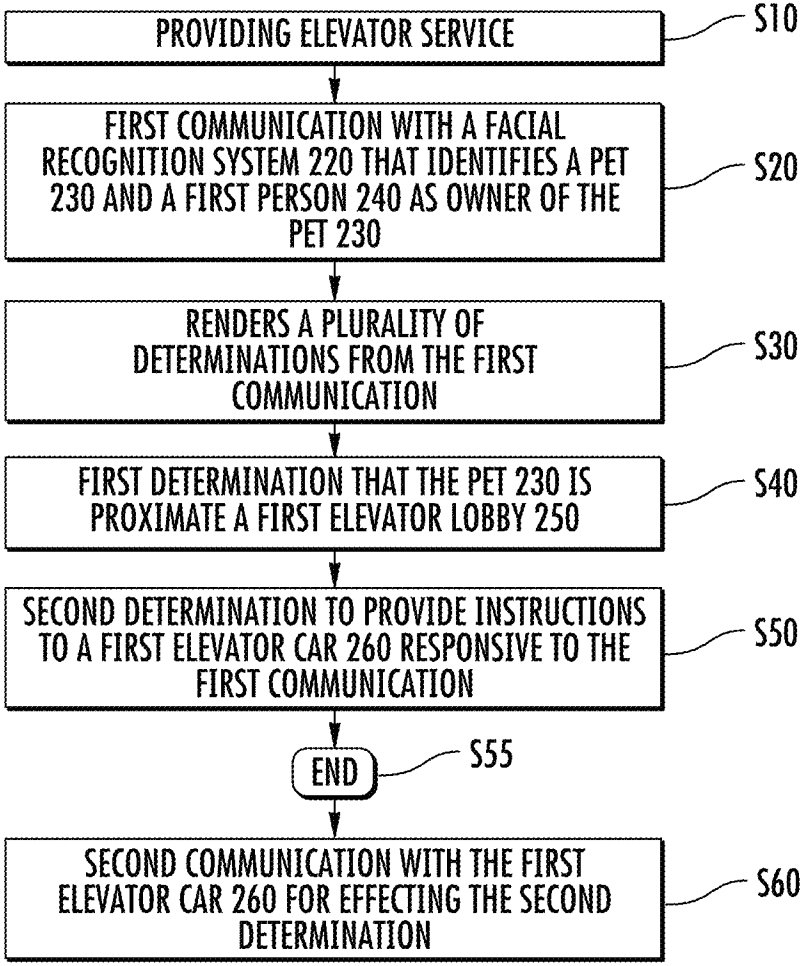
FIG. 5 illustrates steps performed by components according to an embodiment wherein the system provides elevator service to a person with a pet.

Turning to FIGS. 2 and 5, disclosed is an elevator system 200 comprising a controller 210. The controller 210 may be configured for performing step S10 of providing elevator service. Step S10 includes step S20 of engaging in a first communication with a facial recognition system 220 that identifies a pet 230 and a first person 240 associated with the pet 230. At step S30 the controller 210 renders a plurality of determinations from the first communication. Step S30 includes the controller 210 performing step S40 of rendering a first determination that the pet 230 is proximate a first elevator lobby 250. At step S50 the controller 210 renders a second determination to provide instructions to a first elevator car 260 responsive to the first communication. At step S55 the determinations of step S30 are concluded. At step S60 the controller 210 engages in a second communication with the first elevator car 260 for effecting the second determination.

Figure 6:
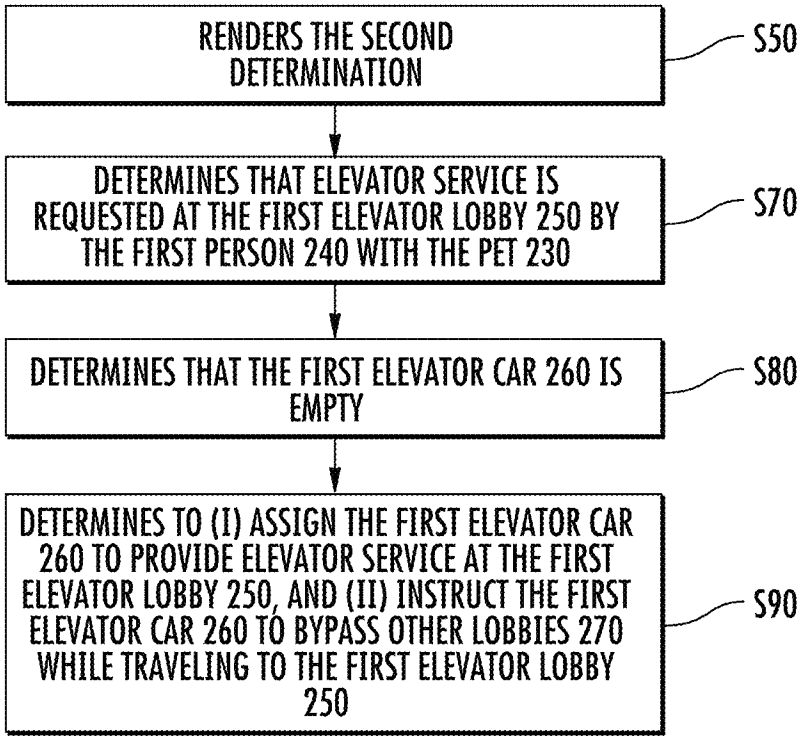
FIG. 6 illustrates steps performed by components according to an embodiment wherein the system provides elevator service to a person with a pet.

With further reference to FIGS. 2 and 6, in one embodiment the second determination includes the controller 210 performing step S70 of determining that elevator service is requested at the first elevator lobby 250 by the first person 240 with the pet 230. At step S80 the controller 210 determines that the first elevator car 260 is empty. At step S90 the controller determines to (i) assign the first elevator car 260 to provide elevator service at the first elevator lobby 250, and (ii) instruct the first elevator car 260 to bypass other lobbies 270 while traveling to the first elevator lobby 250.

Figure 3:
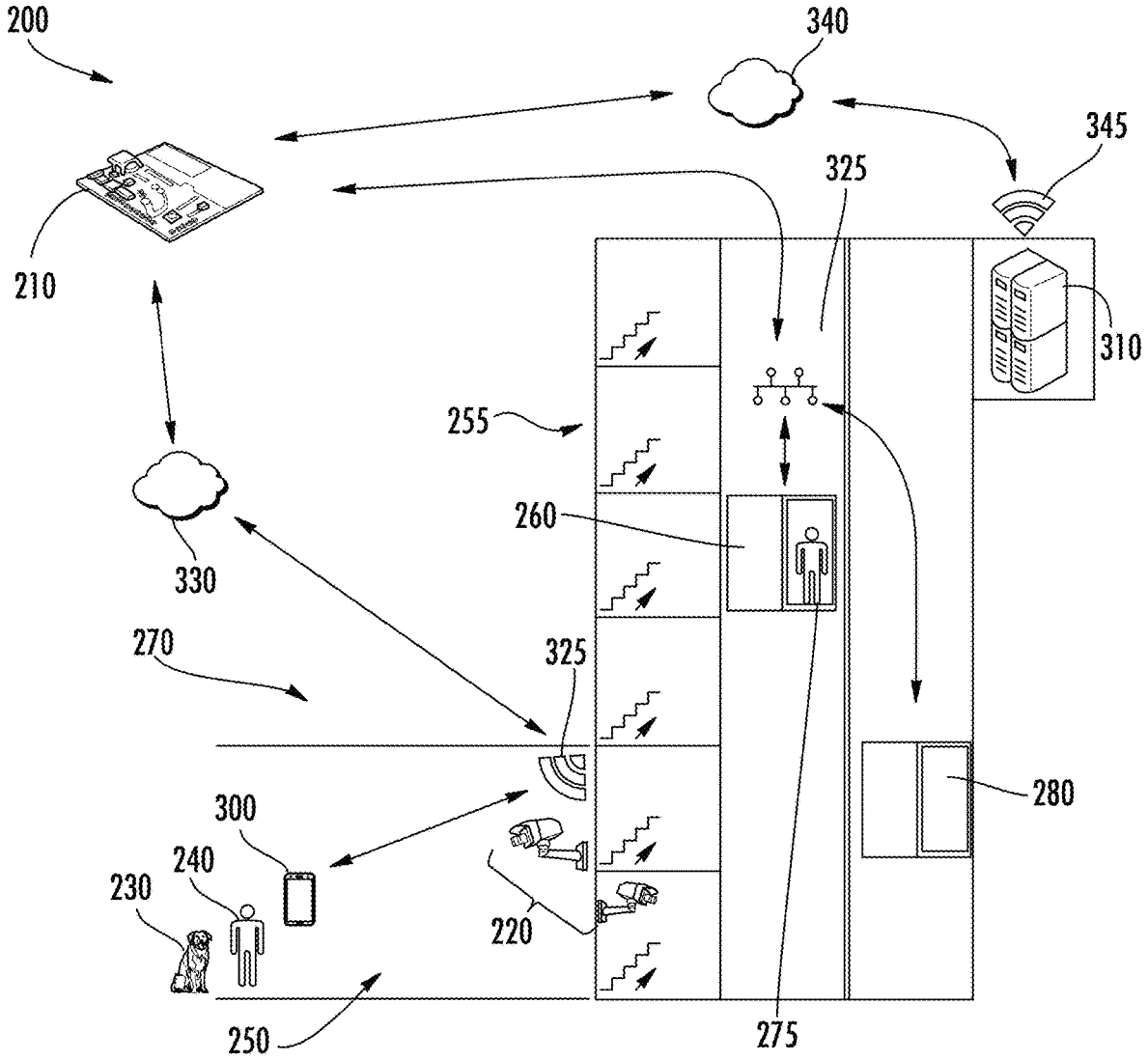
FIG. 3 illustrates components of a disclosed embodiment wherein the system provides elevator service to a person with a pet while a passenger is on an elevator.
Figure 7:
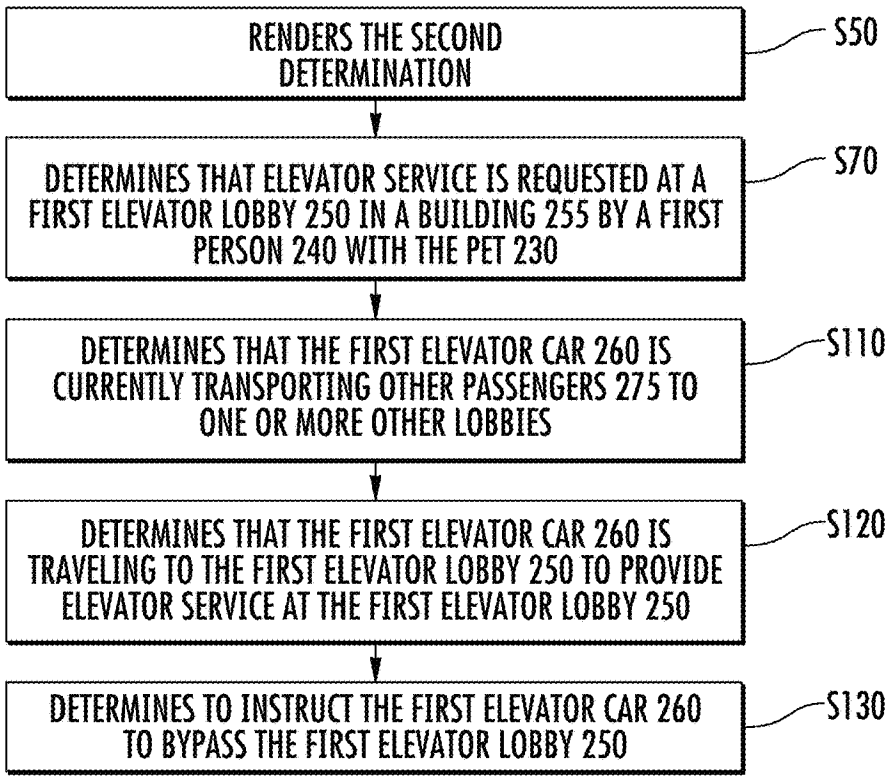
FIG. 7 illustrates steps performed by components according to an embodiment wherein the system provides elevator service to a person with a pet while a passenger is on an elevator.

As further illustrated in FIGS. 3 and 7, in one embodiment the second determination includes the controller 210 again performing step S70 of determining that elevator service is requested at a first elevator lobby 250 in a building 255 by a first person 240 with the pet 230. At step S110 the controller 210 determines that the first elevator car 260 is currently transporting other passenger's 275 to one or more other lobbies. At step S120 the controller 210 determines that the first elevator car 260 is traveling to the first elevator lobby 250 to provide elevator service at the first elevator lobby 250. At step S130 the controller 210 determines to instruct the first elevator car 260 to bypass the first elevator lobby 250.

Figure 8:
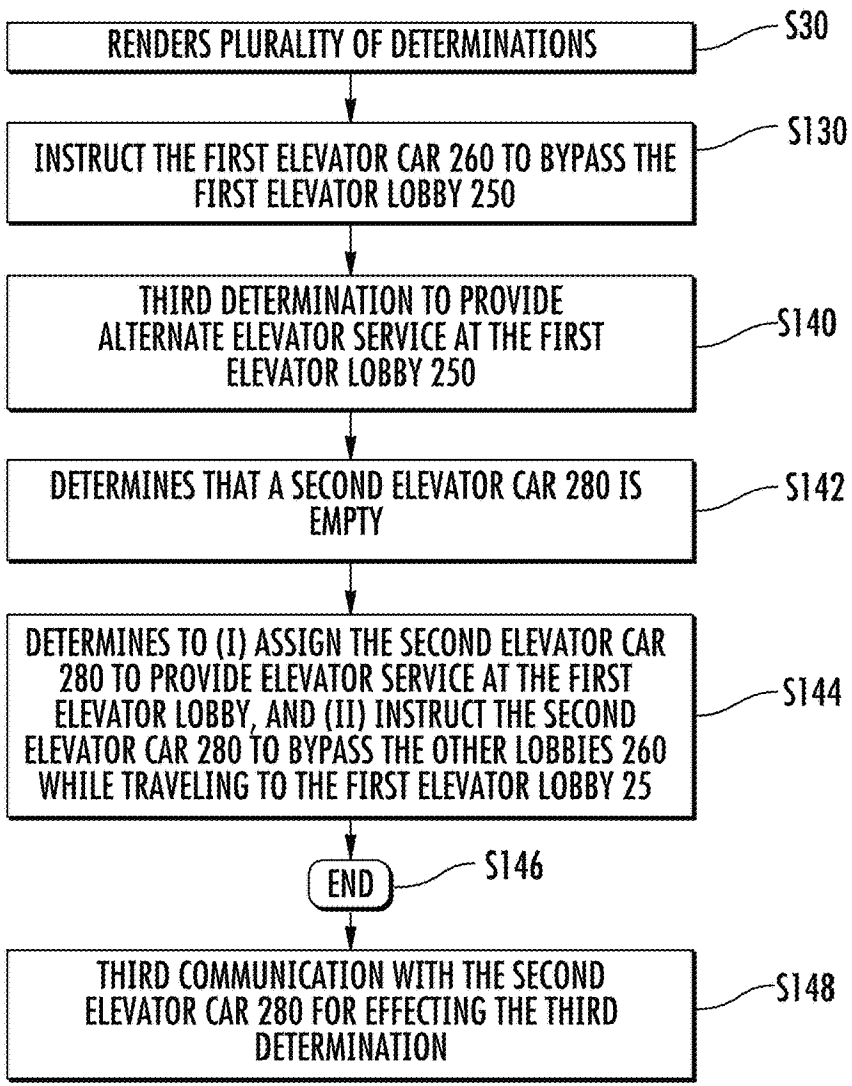
FIG. 8 illustrates steps performed by components according to an embodiment wherein the system provides elevator service to a person with a pet while a passenger is on an elevator.

Turning to FIGS. 3 and 8, and continuing with step S30, after performing step S130 the controller 210 may perform step S140 of rendering a third determination to provide alternate elevator service at the first elevator lobby 250. At step S142 includes the controller 210 determining that a second elevator car 280 is empty. At step S144 the controller 210 may determine to (i) assign the second elevator car 280 to provide elevator service at the first elevator lobby, and (ii) instruct the second elevator car 280 to bypass the other lobbies 260 while traveling to the first elevator lobby 250. At step S146 the third determination is completed. At step S148 the controller 210 may engage in a third communication with the second elevator car 280 to effect the third determination.

Figure 4:
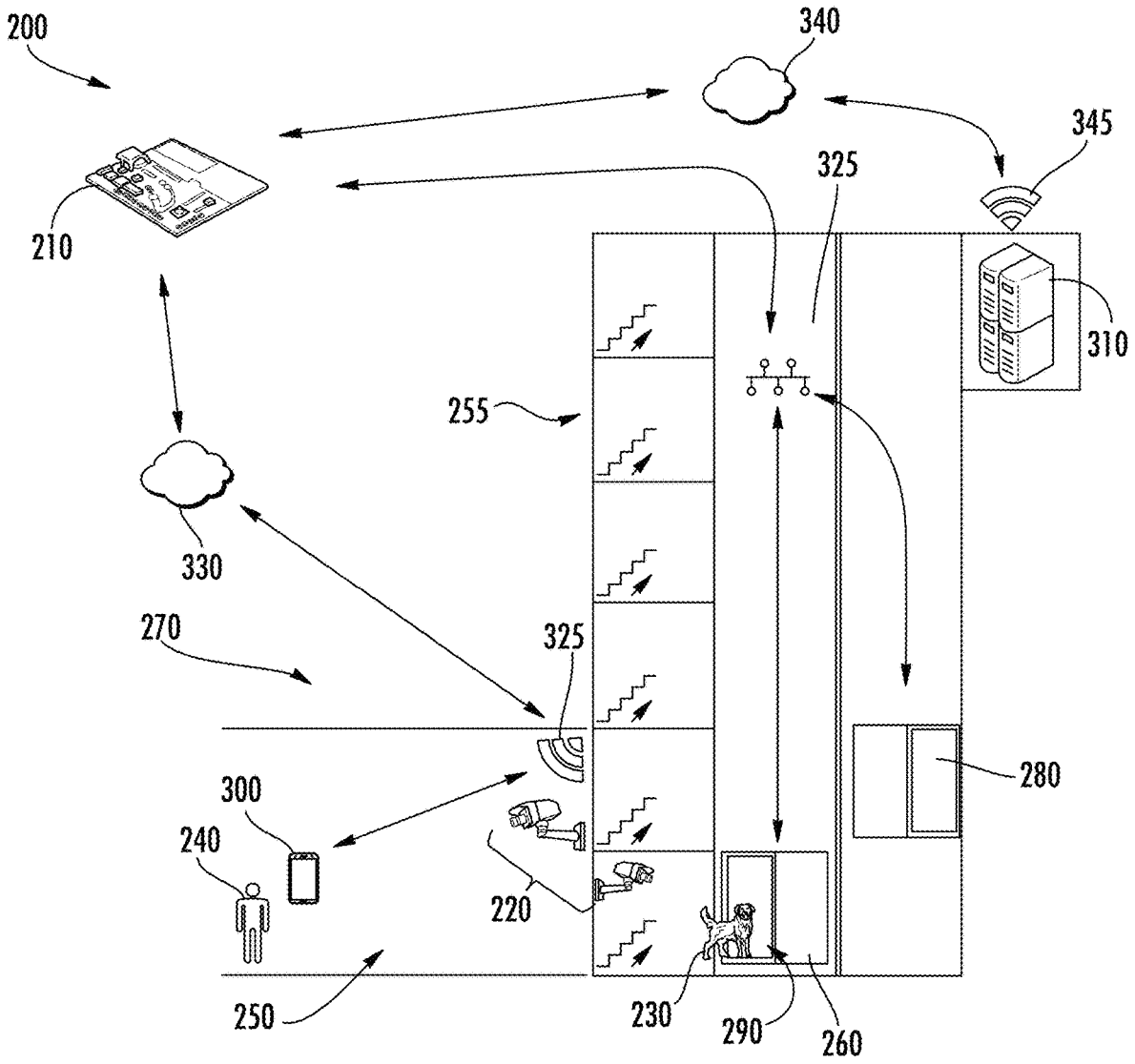
FIG. 4 illustrates components of a disclosed embodiment wherein the system identifies an unattended pet entering an elevator.
Figure 9:
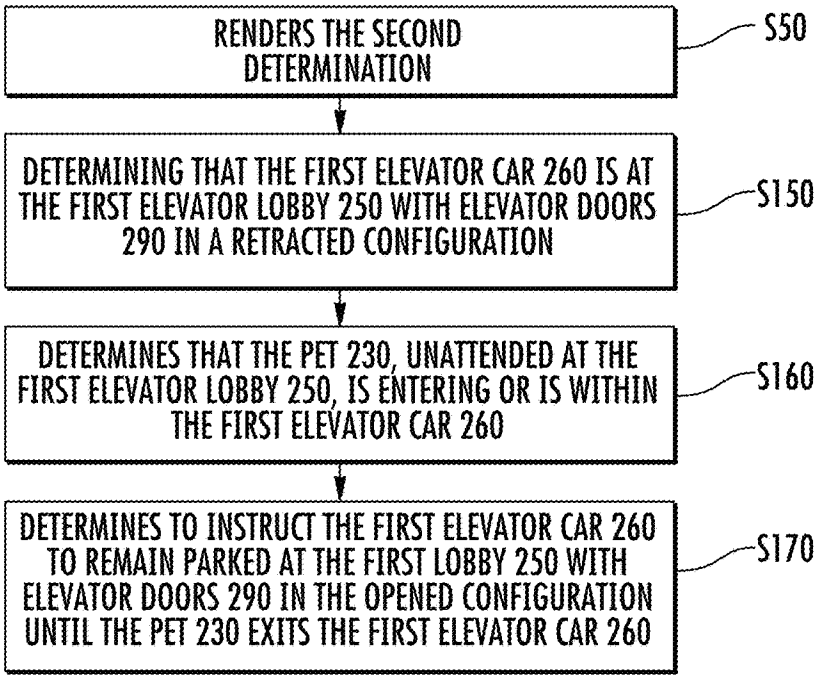
FIG. 9 illustrates steps performed by components according to an embodiment wherein the system identifies an unattended pet entering an elevator.

As illustrated in FIGS. 4 and 9, according to an embodiment the second determination includes step S150 of the controller 210 determining that the first elevator car 260 is at the first elevator lobby 250 with elevator doors 290 in a retracted configuration. At step S160 the controller 210 determines that the pet 230, unattended at the first elevator lobby 250, is entering or is within the first elevator car 260. At step S170 the controller 210 determines to instruct the first elevator car 260 to remain parked at the first lobby 250 with elevator doors 290 in the opened configuration until the pet 230 exits the first elevator car 260.

Figure 10:
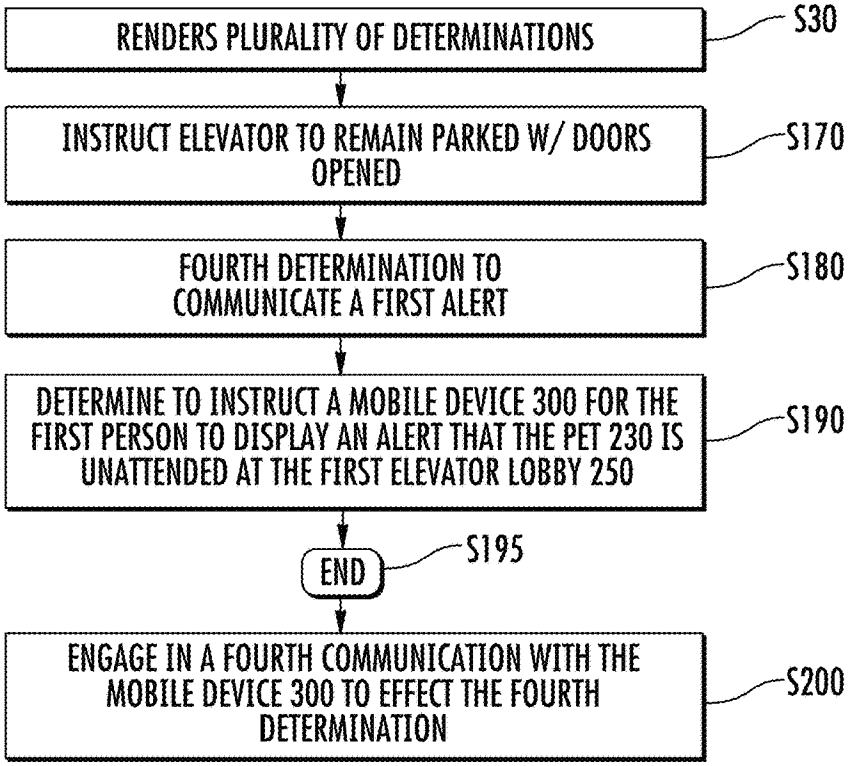
FIG. 10 illustrates steps performed by components according to an embodiment wherein the system identifies an unattended pet entering an elevator.

As illustrated in FIGS. 4 and 10, and continuing with step S30, after performing step S170 the controller 210 may perform step S180 of rendering a fourth determination to communicate a first alert which is a pet attendance alert. At step S190 the controller 210 may determine to instruct a mobile device 300 for the first person to display an alert that the pet 230 is unattended at the first elevator lobby 250. At step S195 the determination at step S180 may conclude. At step S200 the controller 210 may engage in a fourth communication with the mobile device 300 to effect the fourth determination.

Figure 11:
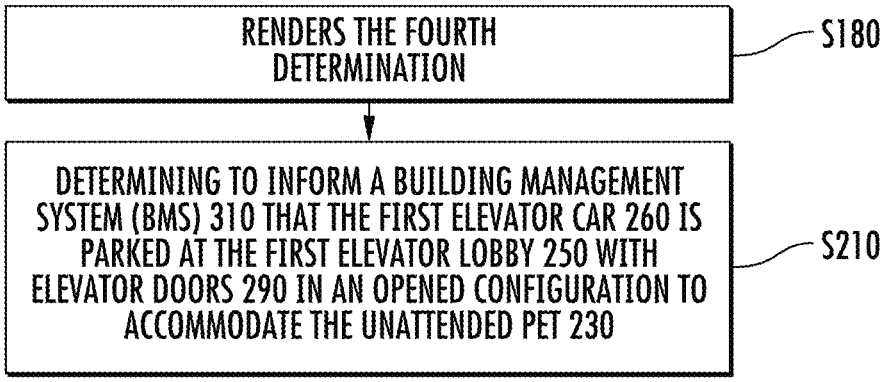
FIG. 11 illustrates steps performed by components according to an embodiment wherein the system identifies an unattended pet entering an elevator.

As illustrated in FIGS. 4 and 11, the fourth determination may include step S210 of determining to inform a building management system (BMS) 310 that the first elevator car 260 is parked at the first elevator lobby 250 with elevator doors 290 in an opened configuration to accommodate the unattended pet 230. According to an embodiment at step S210 may include the controller 210 identifying to the BMS 310 the first person 240 as associated with the pet 230.

The controller 210 may communicate with the first elevator car 260 over a controller area network (CAN) with a CAN Bus 325. In addition the controller 210 communicates with the mobile device 300 over a personal area network (PAN) 330 over a network beacon 335. The controller may communicate with the BMS 310 over a local area network (LAN) 340 over a LAN access point 345. The CAN bus 325, PAN 330 and LAN 345 are examples of suitable networks; it is understood that other network topologies may be used in the elevator system 200.

According to the above disclosed embodiments an elevator system may determine when a person who is a pet owner request elevator service accompanied by the pet. Such determinations may be based on image processing techniques. These configurations may avoid an inconvenience to other passengers without pets from sharing elevator cars with the pet. According to other disclosed embodiments, utilizing facial recognition implements, the elevator system may identify and track an unattended pet and inform the pet owner and Building Management Systems (BMS) of the presence and activities of the unintended pet.

More specifically, in one embodiment disclosed above a first person with a pet arrives at a first elevator lobby in a building. The first person may effect a first elevator call, for example with an elevator App (Apps are defined in further detail below) on a mobile device, or a first elevator panel in the first elevator lobby. In this embodiment, the elevator system may include an elevator controller and plurality of elevator cars. Pursuant to the first elevator call, the controller may assign a first elevator car, which is currently empty, to provide first elevator service to the first elevator lobby. With the first assignment the controller may control the first elevator car to bypass elevator lobbies between a current positon of the first elevator and the first elevator lobby.

In an application of the disclosed embodiments passengers may be waiting at the first elevator lobby when the first person arrives with the pet. Pursuant to a previous elevator call the first elevator car, with passengers therein, may be already assigned to arrive at the first elevator lobby. The controller may cancel the current elevator assignment and instruct the first elevator to bypass the first elevator lobby. The controller may then execute an assignment to a second elevator car, which is currently empty, to provide elevator service to the first elevator lobby. Once the second elevator car arrives at the first elevator lobby, the first plurality of passengers may determine whether to join the first person with the pet in the second elevator car.

In yet another embodiment, the controller utilizes face recognition techniques to map faces of persons who are pet owners and also to map faces of their pets. Image capturing implements, such as a video camera positioned in the lobby, may monitor and stream captured images this to the system controller. The controller may detect and recognize an unattended pet at a third elevator lobby and electronically contact the pet owner and a Building Management System (BMS) team to identify the presence of the unattended pet. Additionally, if an unintended pet enters the first elevator, the controller may instruct the first elevator to keep doors open for the pet so the pet may de-board the first elevator car. The controller may inform the first person and the BMS of activity of the unattended pet.

As used herein, mobile devices may be "smart devices" and may contain one or more processors capable of communication using with other such devices by applying wired and/or wireless telecommunication protocols. Non-limiting examples of a smart device include a mobile phone, personal data assistant (PDA), tablet, watch, wearable or other processor-based devices. Protocols applied by smart devices may include local area network (LAN) protocols and/or a private area network (PAN) protocols. LAN protocols may apply Wi-Fi technology for communicating over Wi-Fi access points. Wi-Fi technology is a technology based on the Section 802.11 standards from the Institute of Electrical and Electronics Engineers, or IEEE. Technology applying PAN protocols may communicate over PAN beacons. PAN technology includes, for example, Bluetooth Low Energy (BTLE), which is a wireless technology standard designed and marketed by the Bluetooth Special Interest Group (SIG) for exchanging data over short distances using short-wavelength radio waves. PAN protocols may also include Zigbee, a technology based on Section 802.15.4 protocols from the Institute of Electrical and Electronics Engineers (IEEE). More specifically, Zigbee represents a suite of high-level communication protocols used to create personal area networks with small, low-power digital radios for low-power low-bandwidth needs, and is best suited for small scale projects using wireless connections. Wireless protocols may further include short range communication (SRC) protocols, which may be utilized with radio-frequency identification (RFID) technology. RFID may be used for communicating with an integrated chip (IC) on an RFID smartcard. Wireless protocols may further include long range, low powered wide area network (LoRa and LPWAN) protocols that enable low data rate communications to be made over long distances by sensors and actuators for machine-to-machine (M2M) and Internet of Things (IoT) applications.

In addition, software applications in the form of an "App", referenced above, may be available from an App Store, which is a digital distribution platform for distributing computer software applications over the Internet. Apps contain program level protocols enabling structured and logical communications between devices.

The disclosed elevator system controller may communicate with the one or more elevators over a Controller Area Network (CAN) bus. A CAN is a vehicle bus standard that allow microcontrollers and devices to communicate with each other in applications without a host computer. CAN is a message-based protocol released by the International Organization for Standards (ISO). Downstream communications from the elevator system controller may be over a LAN.

Further, a building management system (BMS), referenced above, may be otherwise known as a building automation system (BAS). The BMS is a computer-based control system installed in buildings that may have a need for controlling and monitoring mechanical and electrical equipment such as ventilation, lighting, power systems, fire systems, security systems, fire alarm systems and elevator systems. In addition to controlling an internal environment in a building, BMS systems may provide for access control (access doors) for implementing building security protocols, or to control other security systems such as closed-circuit television (CCTV) and motion detectors. A BMS may be responsible for controlling equipment that accounts for a majority of energy usage in a building. As indicated the elevator system controller may communicate with the BMS over a LAN.

Yet further, as described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising a controller, wherein the controller is configured for:

engaging in a first communication with a facial recognition system that identifies a pet and a first person and rendering a plurality of determinations from the first communication, including:

a first determination that the pet is proximate a first elevator lobby in a building, a second determination to provide instructions to a first elevator car responsive to the first communication, and engaging in a second communication with the first elevator car for effecting the second determination.

2. The system of claim 1 wherein the second determination includes:

determining that elevator service is requested at the first elevator lobby by the first person with the pet, determining that the first elevator car is empty, and determining to assign the first elevator car to provide elevator service at the first elevator lobby, and to instruct the first elevator car to bypass other lobbies while traveling to the first elevator lobby.

3. The system of claim 1 wherein the second determination includes:

determining that elevator service is requested at a first elevator by the first person with the pet, determining that the first elevator car is currently transporting other passengers to one or more other lobbies, determining that the first elevator car is traveling to the first elevator lobby to provide elevator service at the first elevator lobby, and determining to instruct the first elevator car to bypass the first elevator lobby.

4. The system of claim 3 wherein the controller renders a third determination to provide alternate elevator service at the first elevator lobby, the third determination including:

determining that a second elevator car is empty, determining to assign the second elevator car to provide elevator service at the first elevator lobby, and to instruct the second elevator car to bypass other lobbies while traveling to the first elevator lobby, and wherein the controller engages in a third communication with the second elevator car for effecting the third determination.

5. The system of claim 1 wherein the second determination includes:

determining that the first elevator car is at the first elevator lobby with elevator doors in a retracted configuration, determining that the pet becomes unattended at the first elevator lobby and the pet is entering or is within the first elevator car, and determining to instruct the first elevator car to remain parked at the first lobby with elevator doors in the opened configuration until the pet exits the first elevator car.

6. The system of claim 5 wherein the controller is configured to:

render a fourth determination to communicate a first alert which is a pet attendance alert, including:

determining to instruct a mobile device for the first person to display an alert that the pet has become unattended at the first elevator lobby, and engaging in a fourth communication with the mobile device to effect the fourth determination.

7. The system of claim 6 wherein the fourth determination includes to contact a building management system (BMS) and informing the BMS that the first elevator car is parked at the first elevator lobby with the elevator doors in an opened configuration to accommodate an unattended pet.

8. The system of claim 1 wherein the controller communicates with the first elevator car over a controller area network (CAN).

9. The system of claim 6 wherein the controller communicates with the mobile device over a personal area network (PAN).

10. The system of claim 7 wherein the controller communicates with the BMS over a local area network (LAN).

11. A method of controlling an elevator system, comprising:

engaging in a first communication with a facial recognition system that identifies a pet and a first person, and rendering a plurality of determinations from the first communication, including:

a first determination that the pet is proximate a first elevator lobby in a building, a second determination to provide instructions to a first elevator car responsive to the first communication, and engaging in a second communication with the first elevator car for effecting the second determination.

12. The method of claim 11 wherein the second determination includes:

determining that elevator service is requested at the first elevator lobby by the first person with the pet, determining that the first elevator car is empty, and determining to assign the first elevator car to provide elevator service at the first elevator lobby, and to instruct the first elevator car to bypass other lobbies while traveling to the first elevator lobby.

13. The method of claim 11 wherein the second determination includes:

determining that elevator service is requested at a first elevator by the first person with the pet, determining that the first elevator car is currently transporting other passengers to one or more other lobbies, determining that the first elevator car is traveling to the first elevator lobby to provide elevator service at the first elevator lobby, and determining to instruct the first elevator car to bypass the first elevator lobby.

14. The method of claim 13 comprising rendering a third determination to provide alternate elevator service at the first elevator lobby, the third determination including:

determining that a second elevator car is empty, determining to assign the second elevator car to provide elevator service at the first elevator lobby, and to instruct the second elevator car to bypass other lobbies while traveling to the first elevator lobby, and the method further comprises engaging in a third communication with the second elevator car for effecting the third determination.

15. The method of claim 11 wherein the second determination includes:

determining that the first elevator car is at the first elevator lobby with elevator doors in a retracted configuration, determining that the pet becomes unattended at the first elevator lobby and the pet is entering or is within the first elevator car, and determining to instruct the first elevator car to remain parked at the first lobby with elevator doors in the opened configuration until the pet exits the first elevator car.

16. The method of claim 15 comprising:

rendering a fourth determination to communicate a first alert which is a pet attendance alert, including:

determining to instruct a mobile device for the first person to display an alert that the pet has become unattended at the first elevator lobby, and engaging in a fourth communication with the mobile device to effect the fourth determination.

17. The method of claim 16 wherein the fourth determination includes to contact a building management system (BMS) and informing the BMS that the first elevator car is parked at the first elevator lobby with the elevator doors in an opened configuration to accommodate an unattended pet.

18. The method of claim 11 wherein the system includes an elevator controller that communications with the first elevator car over a controller area network (CAN) to effect the second denervation.

19. The method of claim 16 wherein the controller communicates with the mobile device over a personal area network (PAN) to effect the fourth determination.

20. The method of claim 17 wherein the controller communicates with the BMS over a local area network (LAN) to informing the BMS that the first elevator car is parked at the first elevator lobby with the elevator doors in an opened configuration to accommodate an unattended pet.

* * * * *